US006220216B1

(12) United States Patent
Häberlein

(10) Patent No.: US 6,220,216 B1
(45) Date of Patent: Apr. 24, 2001

(54) FOUR-STROKE RECIPROCATING INTERNAL COMBUSTION ENGINE

(75) Inventor: Jürgen Häberlein, Murrhardt (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/352,403

(22) Filed: Jul. 14, 1999

(30) Foreign Application Priority Data

Jul. 30, 1998 (DE) ..... 198 34 398

(51) Int. Cl.[7] ..... F01M 1/00
(52) U.S. Cl. ..... 123/196 R; 184/6.8; 184/13.1
(58) Field of Search ..... 123/196 R; 184/13.1, 184/6.5, 6.8

(56) References Cited

FOREIGN PATENT DOCUMENTS 197 38 155 3/1998 (DE) .

*Primary Examiner*—Noah P. Kamen
(74) *Attorney, Agent, or Firm*—Walter Ottesen

(57) ABSTRACT

The invention is directed to a reciprocating internal combustion engine including a four-stroke engine. A longitudinally movable piston drives a crankshaft via a crank drive and a connecting rod. The crankshaft is journalled in a crankcase containing a lubricating oil for the crank drive. The chamber containing the lubricating oil is formed adjacent the cylinder by barrier walls within the crankcase as an oil receptacle to hold the lubricating oil in the overhead position of the cylinder. The crankcase is configured to have a trough-like shape and holds the lubricating oil and the cylinder projects axially into the crankcase and defines the barrier wall of the oil receptacle with its cylinder jacket. In this way, adequate lubrication is guaranteed in every operating position of the engine.

11 Claims, 1 Drawing Sheet

FOUR-STROKE RECIPROCATING INTERNAL COMBUSTION ENGINE

BACKGROUND OF THE INVENTION

In reciprocating internal combustion engines, a piston is guided for longitudinal movement in a cylinder and the piston drives a crankshaft via a connecting rod. The crankshaft is rotatably journalled in a crankcase which contains lubricating oil for the crank drive. The connecting rod is pivotally held on a crankpin arranged eccentrically to the rotational axis of the crankshaft.

If such a reciprocating engine is utilized in a portable handheld work apparatus such as a motor-driven chain saw or the like to drive the work tool, then the engine is regularly moved out of its stand up normal alignment when, for example, the work tool and therefore the drive motor are guided sideways or even overhead. Without suitable countermeasures, the lubricating oil flows in the direction of the piston and can enter the combustion chamber. This can effect the proper operation of the engine especially when the apparatus is put down at engine standstill in the overhead position of the engine. It is even possible that lubricating oil drips out of the engine.

German patent publication 197 38 155 discloses a four-stroke internal combustion engine having a chamber next to the cylinder and which chamber contains lubricating oil. The chamber is configured as an oil receptacle with baffle walls within the crankcase in which the lubricating oil is taken up when the cylinder is in an overhead position. An oil catcher is movable with the crankpin about the rotational axis of the crankshaft and projects into the chamber containing the lubricating oil. The oil catcher is intended to catch lubricating oil and spray the lubricating oil onto the components to be lubricated at high rpm of the crankshaft.

In the known engine, the crankcase is configured to have a double wall. The inner baffle wall encloses the components of the crank drive and the outer wall of the crankcase surrounds the inner wall. The space, which is formed between the baffle wall and the outer wall, holds the lubricating oil for the crank drive. A slot is formed in the baffle wall and extends on the side of the baffle wall in the peripheral direction. This side of the baffle wall lies opposite the piston. The oil catcher projects through the slot into the chamber containing the lubricating oil and the oil bath contained therein.

The outer wall of the lubricating oil chamber is connected to the inner wall above the crankshaft, that is, on the side facing toward the cylinder whereby an oil catch is formed. In the side position and in the overhead position, the oil catch holds the lubricating oil, which flows in the direction of the cylinder, back into the oil chamber. The crank chamber, which is closed off by the baffle wall, is thereby separated from the lubricating oil chamber whereby a wetting of the backside of the piston is precluded in a position of the engine deviating from the normal alignment. The oil catcher is configured radially on the crankpin but enters only segmentwise through the slot into the oil chamber during its revolution and therefore can only catch lubricating oil and move the same to the crank drive when the engine is in its upright position and the lubricating oil is disposed at the base of the lubricating chamber and accessible for the oil catcher. Although the oil is prevented from entering into the crank chamber in the overhead position of the engine, a lubrication is, however, no longer provided so that operating disturbances of the engine can occur very quickly.

SUMMARY OF THE INVENTION

It is an object of the invention to improve a reciprocating piston engine in such a manner that an adequate lubrication of the movable components is ensured in every operating position of the reciprocating piston engine.

The reciprocating internal combustion engine of the invention includes: a cylinder defining a longitudinal axis and having a cylinder wall; a piston guided to move longitudinally in the cylinder; a crankcase connected to the cylinder; a crankshaft rotatably journalled in the crankcase and defining a rotational axis; a crank drive including a crankpin operatively connected to the crankshaft and the crankpin being arranged eccentrically to the rotational axis; a connecting rod pivotally connected to the crankpin; the piston being connected to the connecting rod for imparting rotational movement to the crankshaft via the crankpin; the crankcase having a crankcase wall defining an interior space and having a first end configured as a sump for holding lubricating oil in a first spatial orientation of the engine; the crankcase having a second end in the region of the cylinder; the cylinder being connected to the crankcase so as to cause the cylinder wall to extend axially into the interior space at the second end of the crankcase; and, the cylinder wall and the crankcase wall conjointly defining a receptacle for catching oil at the second end of the crankcase in a second spatial orientation of the engine.

The crankcase is configured so as to have a trough-like shape and contains the lubricating oil. The cylinder projects axially into the crankcase and forms a wall of the oil receptacle with its outer wall surface. The cylinder and the crankcase are thereby axially pushed one inside the other whereby the space that the piston engine occupies is reduced. The oil receptacle is defined by the crankcase wall and the inwardly projecting wall of the cylinder outside of the region of movement of the crank drive. In this oil receptacle, the lubricating oil collects in the overhead position of the reciprocating piston engine. The oil receptacle is open toward the crank chamber and the crank drive disposed therein whereby the lubricating oil is held in movement by the crank drive also in positions deviating from the upright position of the crankcase. If the reciprocating piston engine is tilted and brought into the overhead position, then the sump oil is lifted from the housing base and caught by the crank drive.

The lubrication and formation of a lubricating oil mist by the crank drive can be augmented by an oil catcher which is movable about the rotational axis with the crankpin and projects into the interior space of the crankcase. For every revolution, a partial volume of the lubricating oil is caught by the oil catcher and sprayed onto the crank drive parts in the crank chamber which are to be lubricated. The oil catcher reaches into the oil receptacle and thereby catches large amounts of the lubricating oil which have collected in the oil receptacle in side and overhead positions of the reciprocating piston engine.

The oil catcher, which rotates about the rotational axis of the crankshaft, either catches the sump oil located at the base in the normal position or the lubricating oil collected in the oil receptacle in the overhead position independently of the alignment of the piston reciprocating engine. Advantageously, the oil catcher is mounted on an end face of a radial crank web of the crankshaft lying opposite the crankpin. The oil catcher is mounted eccentrically to the rotational axis and extends radially into the oil receptacle. The oil catcher rotates freely in the crankcase with the crank web. Preferably, crank webs are mounted on both sides of the crankpin and each crank web is provided with an oil catcher whereby the lubricating capacity is overall increased and is doubled in the overhead operation. Even in the lateral positions of the reciprocating piston engine, the lubrication can always be maintained.

The crankcase can advantageously be configured symmetrically to the longitudinal axis of the cylinder and, in this way, the oil receptacle can be configured to have an annular shape about the cylinder. Advantageously, the cylinder is placed with a radial flange on a flange of the crankcase whereby the cylinder wall projects into the crankcase in the built-in position of the cylinder. The radial flange is configured so as to be axially spaced from where the cylinder opens to the crankcase. The interface plane of the cylinder flange and of the crankcase flange purposefully lies orthogonally to the longitudinal axis of the cylinder so that the cylinder can be easily assembled. During assembly, the cylinder is pushed axially into the crankcase and onto the piston, which is already located therein, until the radial flange comes into abutting contact on the crankcase and is thereafter tensioned. The housing wall of the crankcase defines a flange collar on which the cylinder is seated with its radial flange. The flange collar is drawn inwardly. The flange collar of the crankcase delimits the oil receptacle in the longitudinal direction of the cylinder.

BRIEF DESCRIPTION OF THE DRAWINGS

The invention will now be described with reference to the single figure (FIG. 1) which shows a four-stroke internal combustion engine equipped with a receptacle for lubricating oil according to an embodiment of the invention.

DESCRIPTION OF THE PREFERRED EMBODIMENTS OF THE INVENTION

Figure 1:
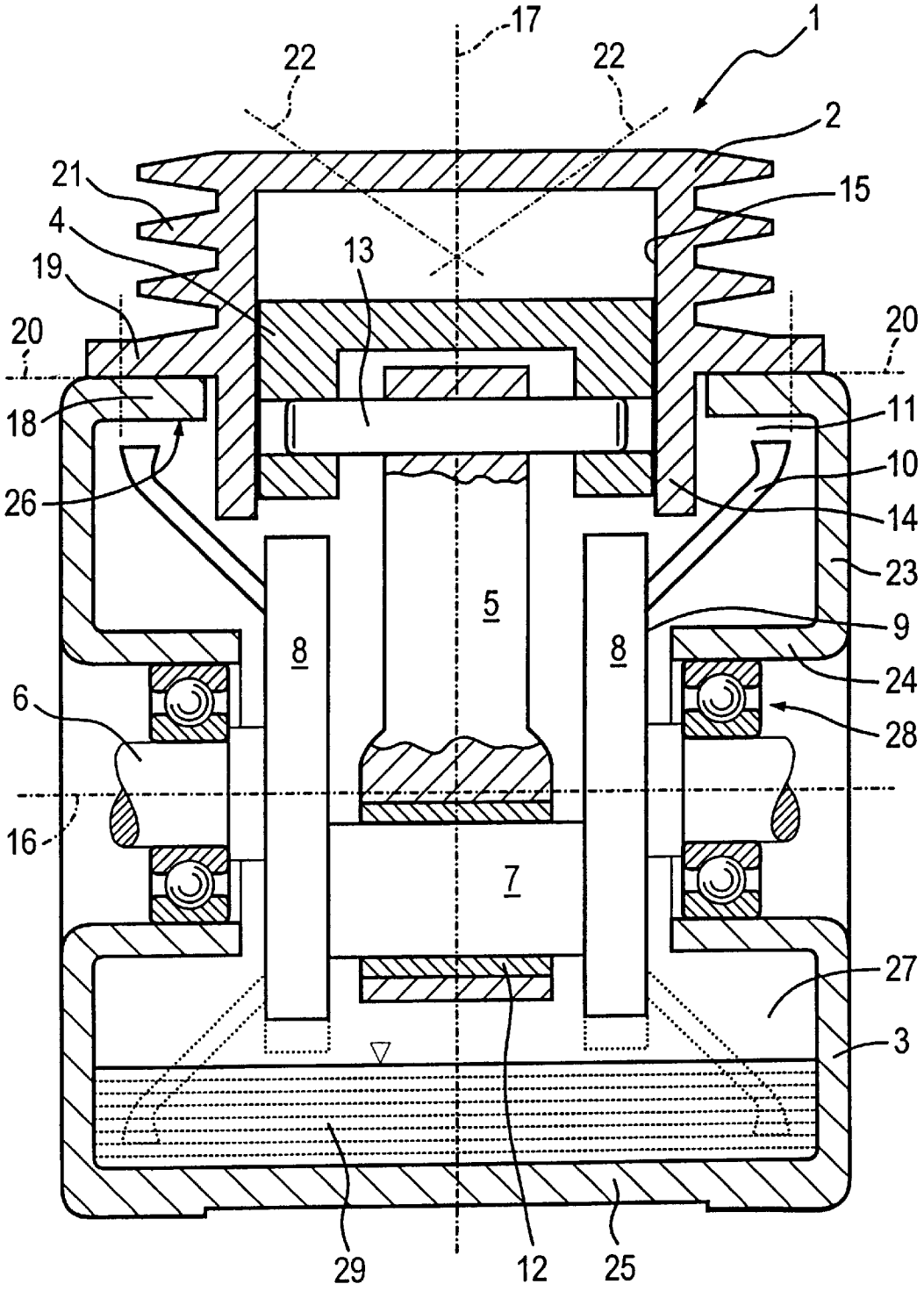

The four-stroke internal combustion engine 1 shown in FIG. 1 includes a cylinder 2, a piston 4 and a connecting rod 5. The piston 4 is longitudinally movable in the cylinder 2 and is journalled so as to be pivotally movable via a piston pin 13 on a connecting rod 5. The connecting rod 5 is held by a connecting rod bearing 12 on a crankpin 7 which is arranged eccentrically to the rotational axis 16 of the crankshaft 6. The longitudinal movement of the piston 4 along the cylinder path 15 is converted via the connecting rod 5 into a rotational movement of the crankshaft 6 in the usual manner of a crank drive. The crankpin 7 is held between two crank webs 8 which serve to balance the mass of the crank drive. The crankshaft 6 is held in the crankcase 3 by shaft bearings 28 adjacent respective crank webs 8.

In the embodiment shown, the shaft bearings 28 are configured as roller bearings which are lubricated with the lubricating oil of the crank drive. In addition to the crankshaft bearings, a crankshaft seal is provided which closes off the interior space 27 of the crankcase. This closure is gas tight and oil tight.

The crankcase 3 has a trough-like configuration and the housing wall 23 is drawn inwardly to a flange collar 18 at the open end of the crankcase 3. The cylinder 2 projects axially into the crankcase 3 through the opening delimited by the flange collar 18. The inwardly projecting part of the cylinder jacket 14 acts as a barrier wall and defines an oil receptacle 11 with the peripheral section of the crankcase housing wall 23. The oil receptacle 11 is delimited in the axial direction by the flange collar 18 and lies outside of the region of movement of the components of the crank drive. The flange surface of the crankcase 3 can, however, also be advantageously configured on the peripherally extending edge of an upright crankcase wall 23 whereby the inner-lying end face of the cylinder flange 19 lying on the crankcase flange delimits the oil receptacle 11. The crankcase can comprise three horizontal parts, namely, an upper flange part, the center part having the shaft bearing 28 and a lower part, namely, an oil sump defining the base 25 of the crankcase 3.

The lubricating oil 29 is next to the base 25 of the crankcase 3 in the upright normal position of the engine 1 shown in FIG. 1. If the engine 1 is brought into a side position or if the cylinder 2 is even in overhead position, then the lubricating oil 29 flows on the wall 23 in the direction of the cylinder 2 and collects in the oil receptacle 11. An oil catcher 10 is mounted on the crank webs 8 on respective end faces 9 lying opposite the crankpin 7. The oil catchers 10 project into the oil receptacle 11. The oil catchers 10 are each connected to the crank webs 8 so as to be eccentric to the rotational axis 16 and rotate freely during operation of the engine. The oil catchers 10 are provided as rod-shaped displacing bodies which reach close to the base 26 of the oil receptacle 11. The oil catchers 10 support the distribution of the lubricating oil in the crank chamber 27 via the moving crank drive parts and the formation of an oil mist. A radially offset oil catcher can also be provided on the connecting rod 5 and project into the oil sump, for example, in the region of the connecting rod bearing 12 which, especially in the start phase of the engine, ensures an immediate lubrication.

In the normal orientation of the engine 1 shown, the oil catchers 10 pass through the oil bath 29 at the housing base 25 with each revolution and, in the overhead position, the lubricating oil, which is collected in this case in the oil receptacle 11, is caught and conveyed to the crank drive. In each possible orientation of the engine 1, it is thereby ensured that the oil catchers 10 come into contact with the lubricating oil 29 in the interior space 27 of the crankcase 3 with each revolution and ensure the lubrication of the crank drive. In the embodiment shown, the oil catchers are mounted on the side of the crank webs 8 lying opposite to the crankpin 7 and thereby contribute to the mass balance of the crank drive. The oil receptacle 11 is configured symmetrically to the cylinder longitudinal axis 17.

The crankshaft bearings 28 are supported on an inwardly drawn wall section 24 of the housing wall whereby the crankshaft bearings 28 lie directly next to the crank webs 8. In this way, the volume of the interior space 27, in which an oil mist must be generated for the purpose of lubrication, is small. The inner-lying surfaces of the inwardly drawn wall sections 24 partition the interior space 27 into two fluid-connected chambers in which the lubricating oil is alternatively collected in dependence upon the orientation of the engine 1. Both chambers of the interior space 27 are run through by the oil catchers 10 with each revolution of the crankshaft 6. In the drawing, the crank drive is shown in the position of bottom dead center and the oil catchers 10 project into the chamber of the crank space close to the cylinder and the oil receptacle 11. At the top dead center of the crank drive, the oil catchers 10 run through the lower base chamber of the crank space 27 as shown by the phantom outline of the oil catchers. The base surface 26 of the oil receptacle 11 is formed by the flange collar 18 and lies somewhat further spaced from the rotational axis 16 of the crankshaft 6 than the base 25 of the crankcase 3 so that the total lubricating oil quantity is accommodated in the oil receptacle 11 and the oil catchers 10 catch lubricating oil with each rotation.

The attachment flange 19 of the cylinder 2 can be defined by a cooling rib 21 on the periphery of the cylinder 2. The flange 19 extends radially further than the cooling ribs 21 in order to make possible an attachment by means of threaded fasteners to the flange collar 18 of the crankcase 3. The partition plane 20 between the flange 19 and the flange collar 18 lies orthogonally to the longitudinal axis 17 of the cylinder whereby the cylinder 2 is insertable in a simple manner into the crankcase 3 with its cylinder jacket 14. In the embodiment shown, reference numeral 22 identifies the gas exchange valves of the engine 1 indicated by their valve axes.

No axial extension of the cylinder 2 compared to conventional configurations is required to form the barrier wall and therefore the oil receptacle 11. Rather, the cylinder length corresponds to the dimension, which is necessary for the piston stroke, and the crankcase wall 23 is extended beyond the plane of the open cylinder end. The cylinder 2 and the crankcase 3 are axially inserted one into the other whereby a reduced axial structural elevation of the engine 1 is achieved.

The four-stroke internal combustion engine according to the invention is especially suitable for use in portable handheld work apparatus such as motor-driven chain saws, cutoff machines, brushcutters and the like. These apparatus are regularly guided by an operator in a side position or an overhead position.

It is understood that the foregoing description is that of the preferred embodiments of the invention and that various changes and modifications may be made thereto without departing from the spirit and scope of the invention as defined in the appended claims.

What is claimed is:

1. A reciprocating internal combustion engine comprising:

a cylinder defining a longitudinal axis and having a cylinder wall;

a piston guided to move longitudinally in said cylinder;

a crankcase connected to said cylinder;

a crankshaft rotatably journalled in said crankcase and defining a rotational axis;

a crank drive including a crankpin operatively connected to said crankshaft and said crankpin being arranged eccentrically to said rotational axis;

a connecting rod pivotally connected to said crankpin;

said piston being connected to said connecting rod for imparting rotational movement to said crankshaft via said crankpin;

said crankcase having a crankcase wall defining an interior space and having a first end configured as a sump for holding a pool of lubricating oil in a first spatial orientation of said engine with said pool of lubricating oil defining an oil surface;

said crankcase having a second end in the region of said cylinder;

said cylinder being connected to said crankcase so as to cause said cylinder wall to extend axially into said interior space at said second end of said crankcase; and, said cylinder wall and said crankcase wall conjointly defining a receptacle for catching oil at said second end of said crankcase in a second spatial orientation of said engine.

2. The reciprocating internal combustion engine of claim 1, further comprising an oil catcher operatively connected to said crankpin so as to be movable about said rotational axis and project into said interior space.

3. A reciprocating internal combustion engine comprising:

a cylinder defining a longitudinal axis and having a cylinder wall;

a piston guided to move longitudinally in said cylinder;

a crankcase connected to said cylinder;

a crankshaft rotatably journalled in said crankcase and defining a rotational axis;

a crank drive including a crankpin operatively connected to said crankshaft and said crankpin being arranged eccentrically to said rotational axis;

a connecting rod pivotally connected to said crankpin;

said piston being connected to said connecting rod for imparting rotational movement to said crankshaft via said crankpin;

said crankcase having a crankcase wall defining an interior space and having a first end configured as a sump for holding lubricating oil in a first spatial orientation of said engine;

said crankcase having a second end in the region of said cylinder;

said cylinder being connected to said crankcase so as to cause said cylinder wall to extend axially into said interior space at said second end of said crankcase;

said cylinder wall and said crankcase wall conjointly defining a receptacle for catching oil at said second end of said crankcase in a second spatial orientation of said engine;

an oil catcher operatively connected to said crankpin so as to be movable about said rotational axis and project into said interior space; and, said oil catcher being configured so as to reach said receptacle.

4. A reciprocating internal combustion engine comprising:

a cylinder defining a longitudinal axis and having a cylinder wall;

a piston guided to move longitudinally in said cylinder;

a crankcase connected to said cylinder;

a crankshaft rotatable journalled in said crankcase and defining a rotational axis;

a crank drive including a crankpin operatively connected to said crankshaft and said crankpin being arranged eccentrically to said rotational axis;

a connecting rod pivotally connected to said crankpin;

said piston being connected to said connecting rod for imparting rotational movement to said crankshaft via said crankpin;

said crankcase having a crankcase wall defining an interior space and having a first end configured as a sump for holding lubricating oil in a first spatial orientation of said engine;

said crankcase having a second end in the region of said cylinder;

said cylinder being connected to said crankcase so as to cause said cylinder wall to extend axially into said interior space at said second end of said crankcase;

said cylinder wall and said crankcase wall conjointly defining a receptacle for catching oil at said second end of said crankcase in a second spatial orientation of said engine;

an oil catcher operatively connected to said crankpin so as to be movable about said rotational axis and project into said interior space;

said crank drive including a radial crank web having first and second end faces;

said crank web being connected to said crankshaft at said first end face and being connected to said crankpin at said second end face; and, said oil catcher being connected to said crank web at said first end face.

5. The reciprocating internal combustion engine of claim 4, wherein said crankshaft has first and second ends rotatably journalled in said crankcase; and, wherein said radial crank web is a first radial crank web and is connected to said first end of said crankshaft; said crank drive including a second radial crank web connected to said second end of said crankshaft; said oil catcher being a first oil catcher and said apparatus comprising a second oil catcher; and, said first and second oil catchers being mounted on said first and second radial crank webs, respectively.

6. The reciprocating internal combustion engine of claim 5, said crankcase being configured to be symmetrical to said longitudinal axis of said cylinder.

7. The reciprocating internal combustion engine of claim 6, said crankcase having a crankcase flange defining an opening through which said cylinder wall extends into said interior space; said cylinder having a cylinder opening facing into said interior space and having a radial flange disposed at an axial spacing from said cylinder opening; and, said radial flange being seated on said crankcase flange; and, said crankcase flange and said radial flange conjointly defining an interface plane orthogonal to said longitudinal axis.

8. The reciprocating internal combustion engine of claim 7, said crankcase flange being configured as an inwardly drawn flange collar.

9. The reciprocating internal combustion engine of claim 8, said inwardly drawn flange collar defining the base of said receptacle and wherein a portion of said crankcase wall defines the base of said sump and the base of said receptacle lying farther from said rotational axis than said base of said sump.

10. The reciprocating internal combustion engine of claim 5, said oil catchers being pin-like displacement bodies.

11. The reciprocating internal combustion engine of claim 10, said crankcase including two inwardly drawn wall sections; and, said engine further comprising two shaft bearings mounted in respective ones of said wall sections for rotatably journalling said first and second ends of said crank shaft, respectively.

* * * * *